US010813452B2

(12) United States Patent
Yang et al.

(10) Patent No.: US 10,813,452 B2
(45) Date of Patent: Oct. 27, 2020

(54) SMART LOGISTICS CABINET AND ADJUSTABLE PARTITION STRUCTURE THEREOF

(71) Applicant: Goldtek Technology Co., Ltd., New Taipei (TW)

(72) Inventors: Wu-Hung Yang, New Taipei (TW); Shian-Wen Shiu, New Taipei (TW); Yu-Chien Hu, New Taipei (TW)

(73) Assignee: Goldtek Technology Co., Ltd., New Taipei (TW)

( * ) Notice: Subject to any disclaimer, the term of this patent is extended or adjusted under 35 U.S.C. 154(b) by 0 days.

(21) Appl. No.: 16/410,056

(22) Filed: May 13, 2019

(65) Prior Publication Data

US 2020/0187643 A1 Jun. 18, 2020

(30) Foreign Application Priority Data

Dec. 13, 2018 (TW) ..... 107144987 A

(51) Int. Cl.
*A47B 57/20* (2006.01)
*A47B 46/00* (2006.01)
*G07C 9/00* (2020.01)

(52) U.S. Cl.
CPC ..... *A47B 57/20* (2013.01); *A47B 46/005* (2013.01); *G07C 9/00896* (2013.01); *G07C 2009/00936* (2013.01)

(58) Field of Classification Search
CPC ..... A47B 57/00; A47B 57/06; A47B 57/08; A47B 57/10; A47B 57/12; A47B 57/14; A47B 57/16; A47B 57/18; A47B 57/20; A47B 57/22; A47B 57/26; A47B 57/265; A47B 96/066; A47B 46/005
See application file for complete search history.

(56) References Cited

U.S. PATENT DOCUMENTS 2,240,086 A * 4/1941 Adler ..... A47B 57/30 108/152
3,397,934 A * 8/1968 Dushek ..... A47B 57/06 312/351
3,885,846 A * 5/1975 Chuang ..... A47B 57/482 312/306

(Continued)

FOREIGN PATENT DOCUMENTS

EP 2250928 A1 * 11/2010 ..... A47B 57/10

*Primary Examiner* — Andrew M Roersma
(74) *Attorney, Agent, or Firm* — ScienBiziP, P.C.

(57) ABSTRACT

An adjustable partition structure includes a guiding member, two sets of support blocks, and an adjustable partition structure. The guiding member is fixed to a rear plate. The two sets of support blocks are respectively disposed on two side plates. Each set of support blocks includes a number of support blocks arranged in a longitudinal direction of the side plates. The adjustable partition structure includes a sliding member and an adjustable partition plate. The sliding member defines a sliding hole. The guiding member is received in the sliding hole. The sliding member is slidable relative to the rear plate along the guiding member. The adjustable partition plate and the sliding member are rotationally coupled together. Two side edges of the adjustable partition plate respectively form an abutting piece. The two abutting pieces are supported by the support blocks on a same plane to support the adjustable partition plate.

17 Claims, 13 Drawing Sheets

(56) References Cited

U.S. PATENT DOCUMENTS

| | | | | |
|---|---|---|---|---|
| 4,790,611 | A * | 12/1988 | Craner | A47B 57/00<br>108/147 |
| 2014/0238383 | A1 * | 8/2014 | Armstrong | F24C 15/16<br>126/337 A |

* cited by examiner

SMART LOGISTICS CABINET AND ADJUSTABLE PARTITION STRUCTURE THEREOF

FIELD

The subject matter herein generally relates to delivery cabinets, and more particularly to a smart logistics cabinet and an adjustable partition structure thereof.

BACKGROUND

Generally, storage cabinets include a plurality of storage spaces used for holding items to be sent or received for delivery. A size of the storage spaces may be difficult to adjust.

BRIEF DESCRIPTION OF THE DRAWINGS

Implementations of the present disclosure will now be described, by way of embodiments, with reference to the attached figures.

DETAILED DESCRIPTION

Figure 1:
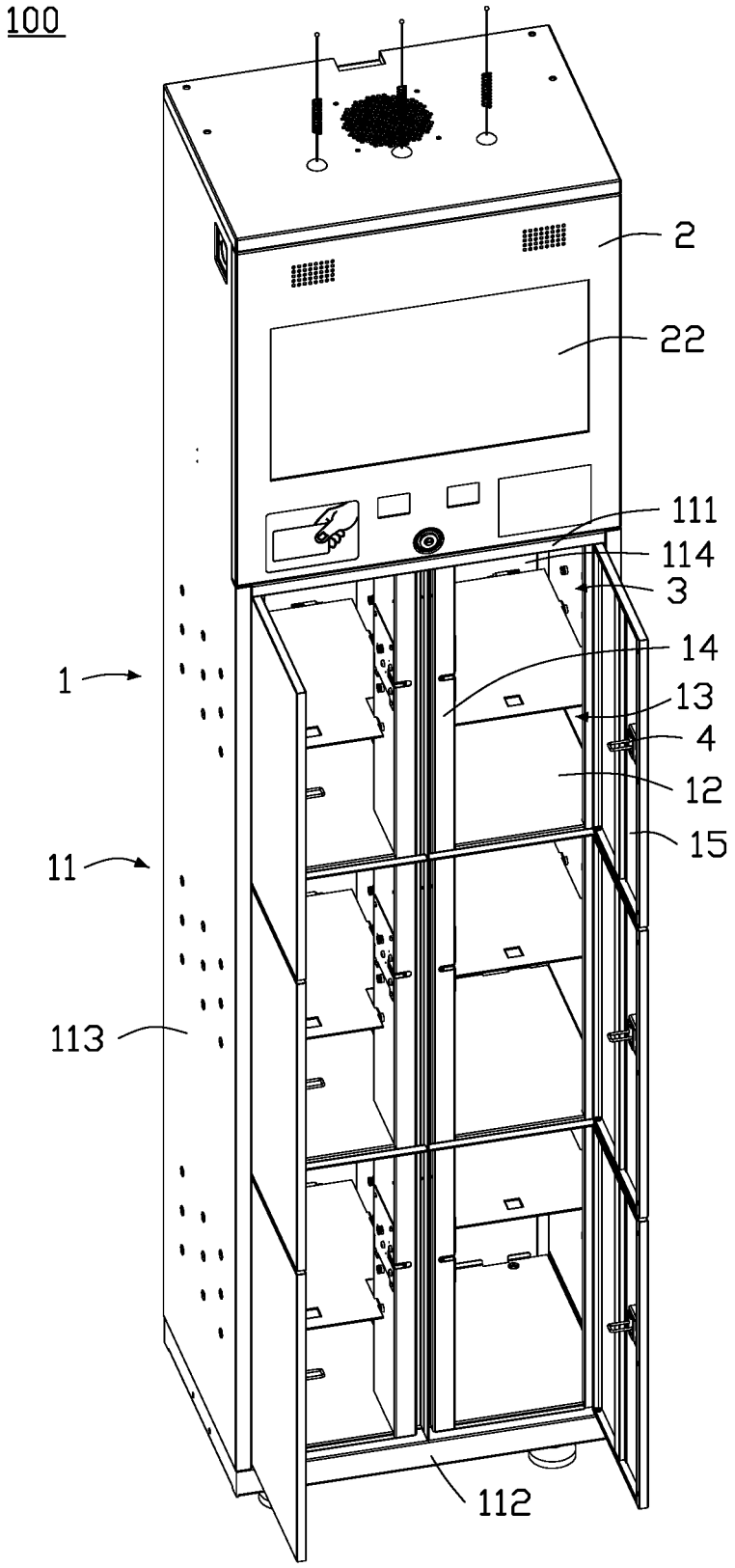
FIG. 1 is a perspective view of an embodiment of a smart logistics cabinet.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of an intelligent logistics cabinet 100 for conveniently sending and collecting items. The intelligent logistics cabinet 100 includes a cabinet 1 and a console 2.

The cabinet 1 includes a frame 11, which is substantially rectangular in cross-section and includes a top plate 111, a base plate 112, at least two side plates 113, and a rear plate 114. A plurality of horizontal fixed partition plates 12 are disposed in an interior of the frame 11 to define a plurality of stacked storage spaces 13. Each of the storage spaces 13 receives an adjustable partition structure 3. A door frame 14 is disposed at an opening of each storage space 13. A door panel 15 is rotationally mounted on the door frame 14, and the door panel 15 includes an electronic door lock 4 which is configured to lock the door panel 15 to the door frame 14.

Figure 2:
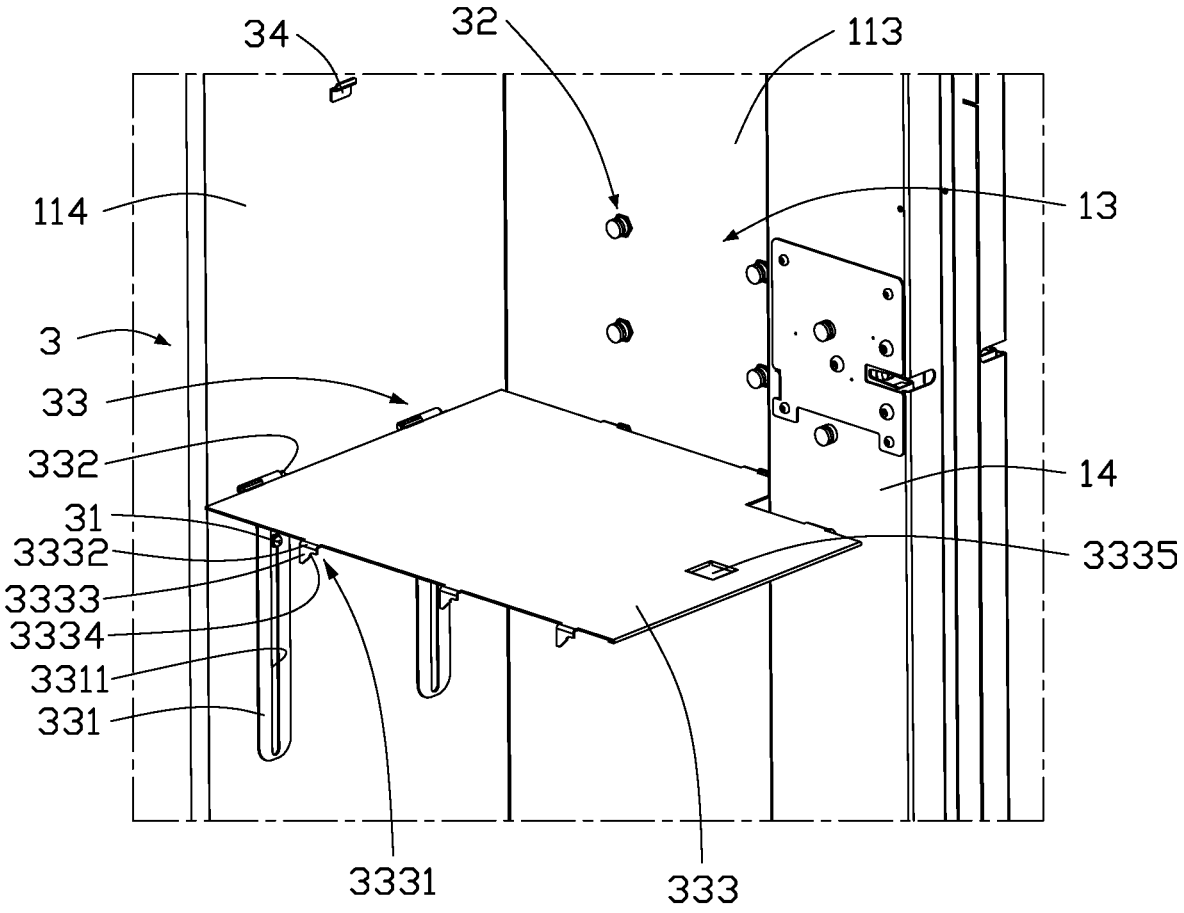
FIG. 2 is a partial perspective view of an adjustable partition structure of the smart logistics cabinet in FIG. 1.
Figure 3:
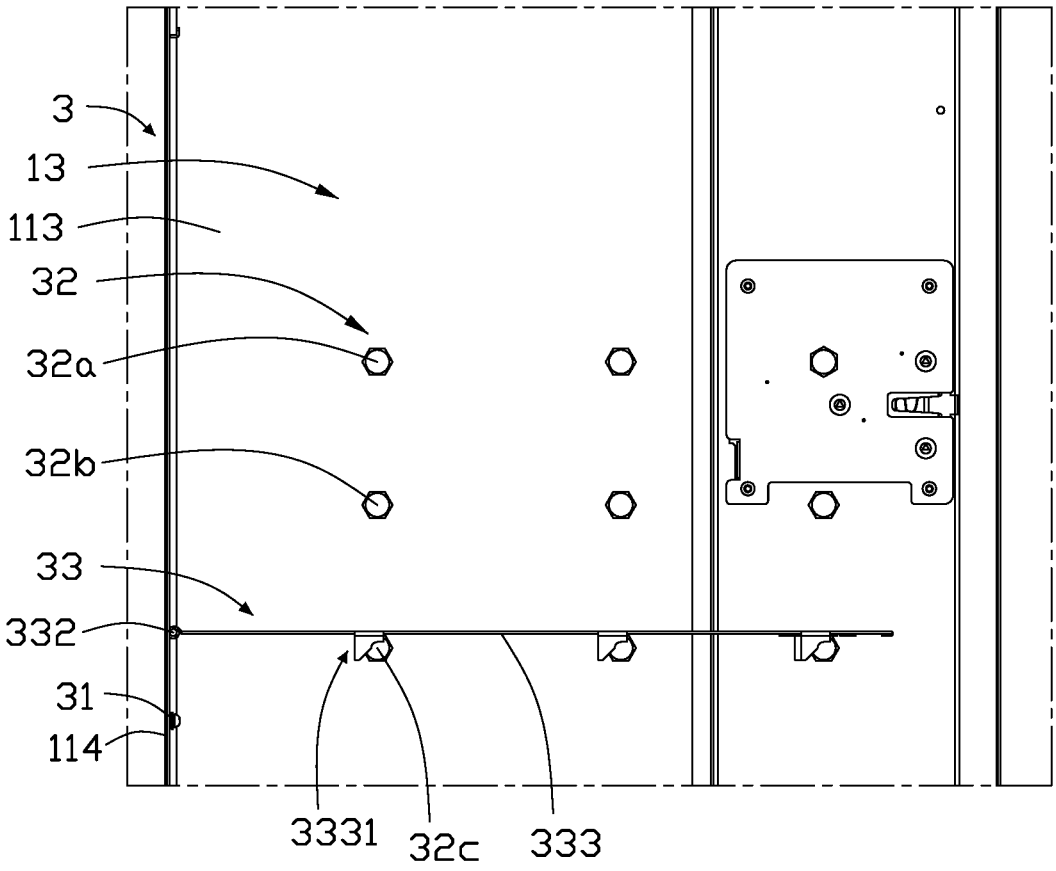
FIG. 3 is a cross-sectional view the adjustable partition structure having an adjustable partition plate at a first position.

As shown in FIGS. 2 and 3, the adjustable partition structure 3 includes at least one guiding member 31, at least two sets of support blocks 32, and an adjustable partition structure 33. The guiding member 31 is fixed on the rear plate 114. Two sets of support blocks 32 are respectively fixed on the two side plates 11. Each set of support blocks 32 includes a plurality of support blocks 32 longitudinally arranged, and the adjustable partition structure 33 includes at least one sliding member 331, at least one pivot shaft 332, and an adjustable partition plate 333. The sliding member 331 is a substantially flat structure defining a sliding hole 3311. The guiding member 31 is received in the sliding hole 3311, so that the sliding member 331 can slide relative to the rear plate 114. One end of the adjustable partition plate 333 is pivotably coupled to an end of the sliding member 331 by the pivot shaft 332. Two side edges of the adjustable partition plate 333 respectively form an abutting piece 3331. The abutting pieces 3331 on opposite sides of the adjustable partition plate 333 are configured to be supported by the support blocks 32 of the two side plates 113 in a horizontal position.

Figure 4:
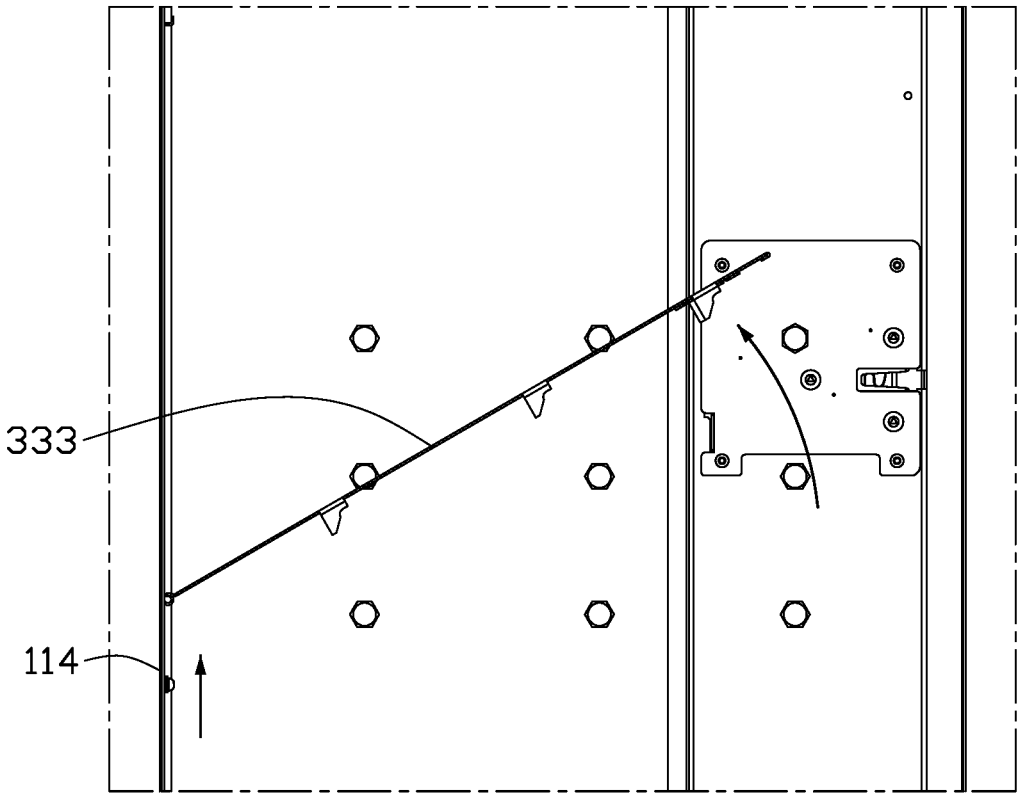
FIG. 4 is a cross-sectional view the adjustable partition structure having the adjustable partition plate at a second position.
Figure 5:
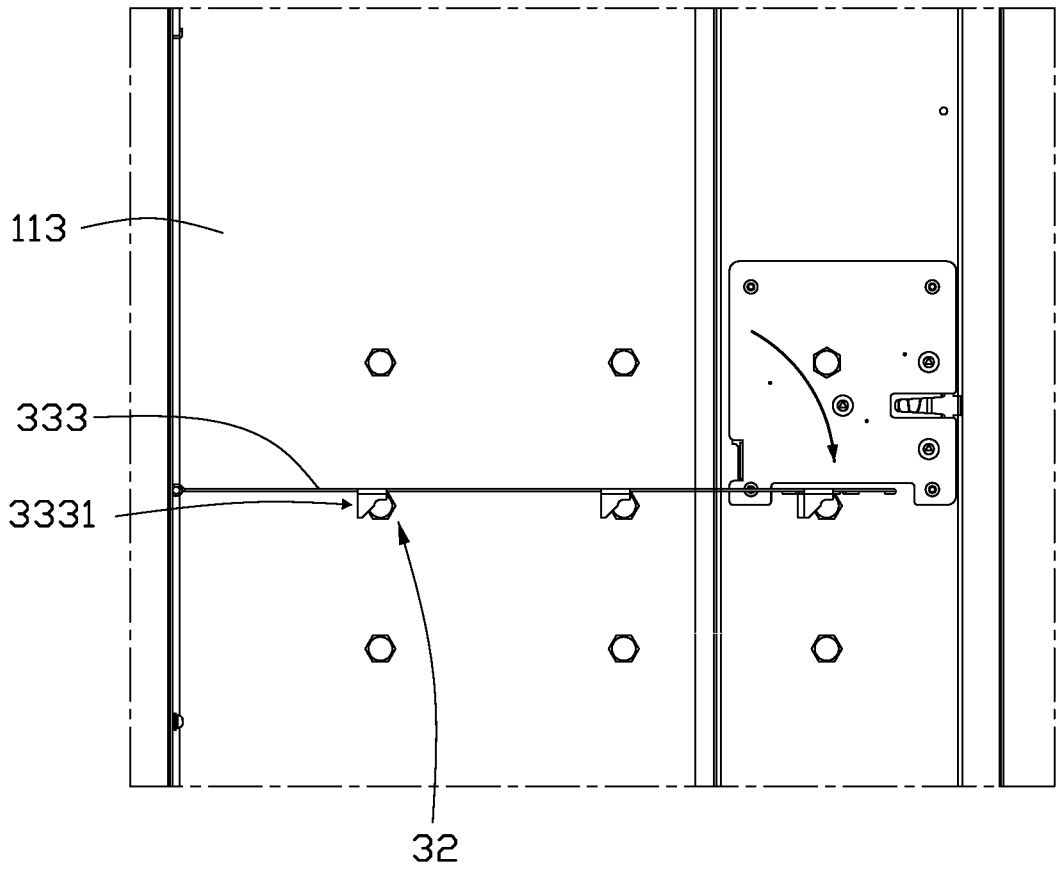
FIG. 5 is a cross-sectional view the adjustable partition structure having the adjustable partition plate at a third position.
Figure 6:
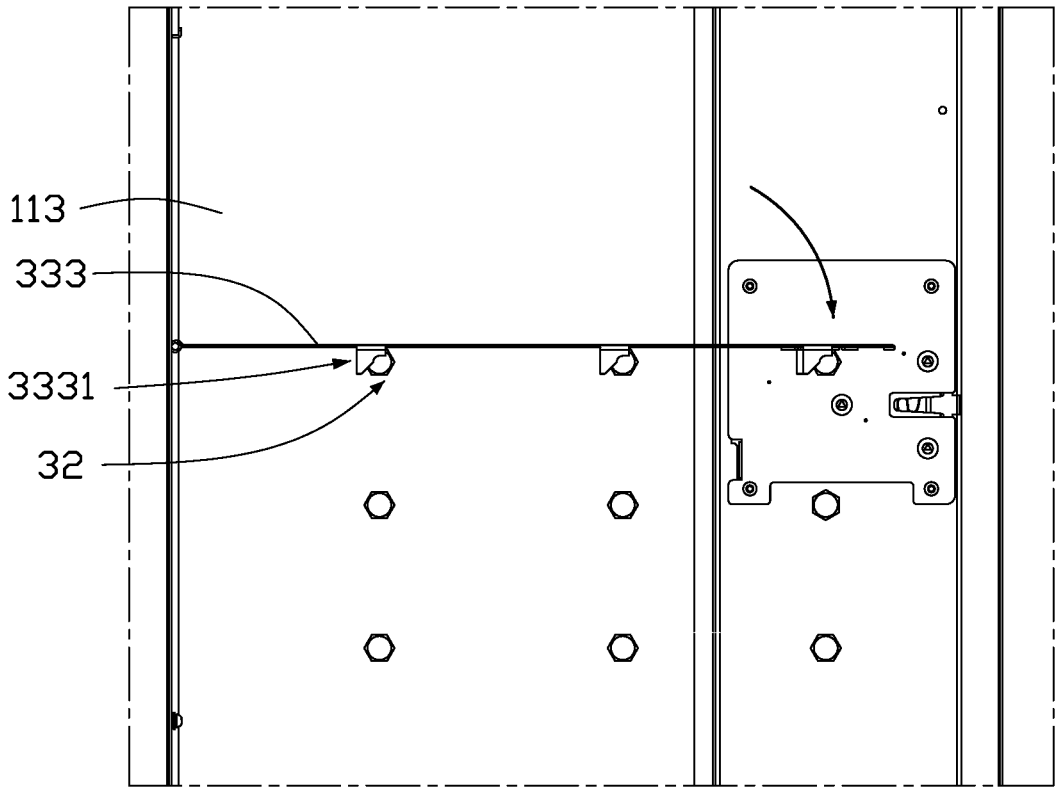
FIG. 6 is a cross-sectional view the adjustable partition structure having the adjustable partition plate at a fourth position.

As shown in FIG. 4, to adjust a size of the storage space 13, the adjustable partition plate 333 is first pivoted upward relative to the sliding member 331, and the adjustable partition plate 333 is moved upward to make the sliding member 331 slide upward relative to the rear plate 114. When the adjustable partition plate 333 is slide to a desired height, as shown in FIG. 5 or FIG. 6, the adjustable partition plate 333 is pivoted downward relative to the sliding member 331, so that the abutting pieces 3331 on both sides of the adjustable partition plate 333 are supported in a horizontal position by the support blocks 32.

Figure 7:
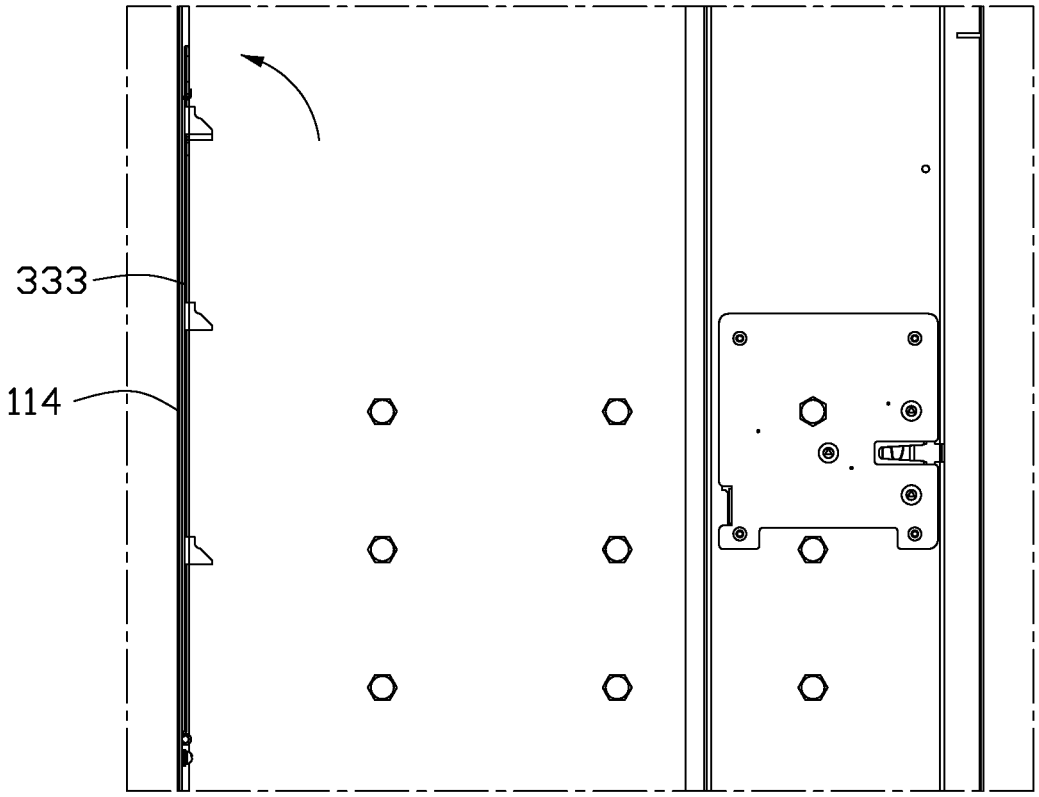
FIG. 7 is a cross-sectional view the adjustable partition structure having the adjustable partition plate at a fifth position.
Figure 8:
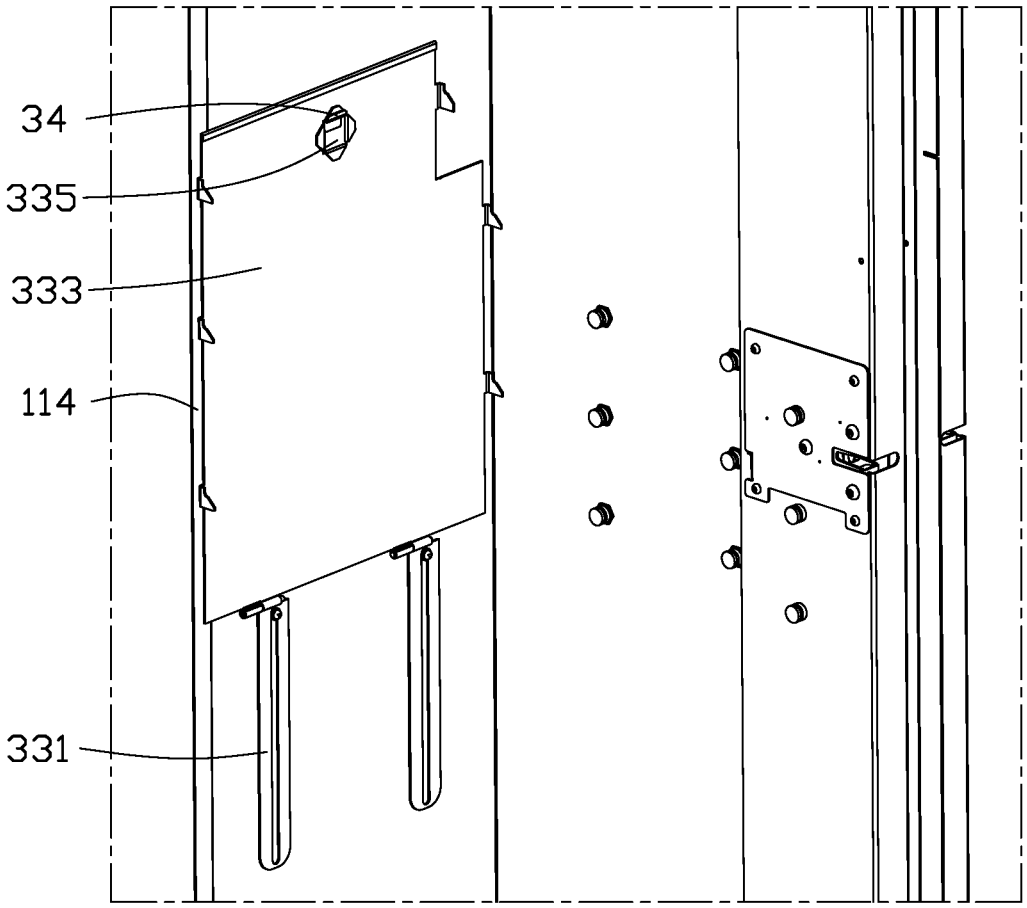
FIG. 8 is a partial perspective view showing a vertical position of the adjustable partition structure.

As shown in FIGS. 7 and 8, the adjustable partition plate 333 can also be pivoted upward in a vertical position to abut against the rear plate 114 to fully open up the storage space 13.

Figure 9:
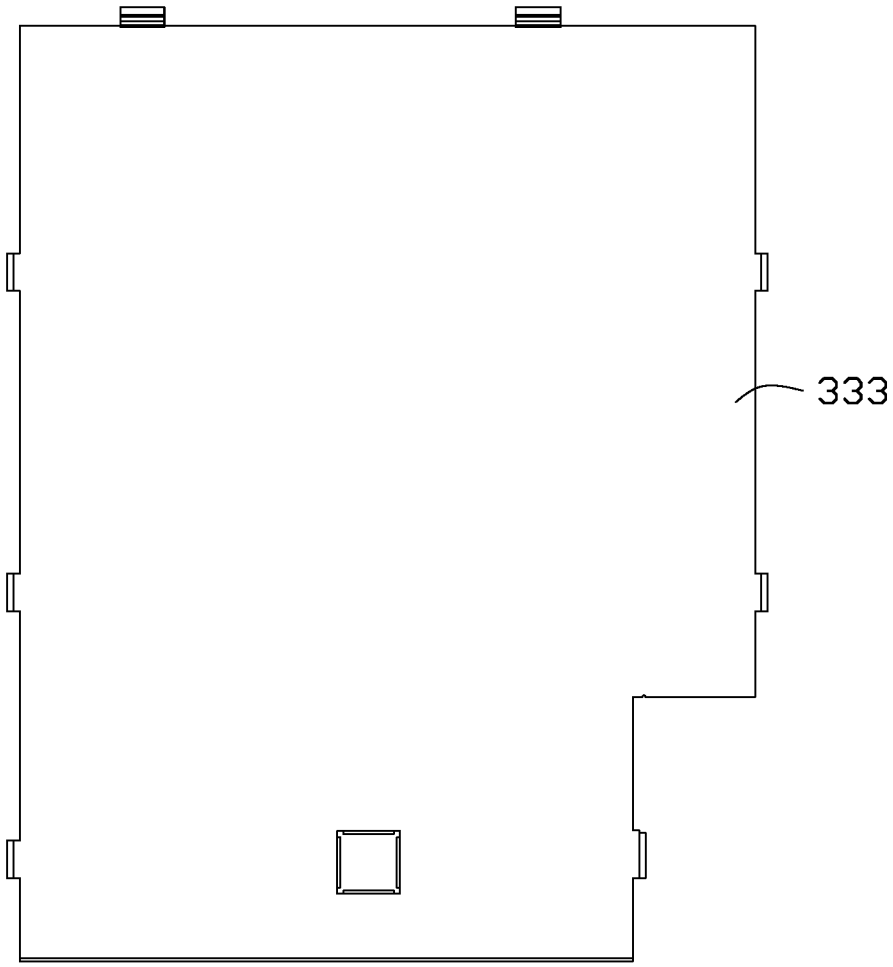
FIG. 9 is a top plan view of an adjustable partition plate of the adjustable partition structure.

FIG. 9 shows the adjustable partition plate 333. A design of the adjustable partition plate 333 prevents the adjustable partition plate 333 from being blocked by the support blocks 32 during a pivoting process. Thus, the adjustable partition plate 333 can be conveniently pivoted to adjust a size of the storage space 13.

Figure 10:
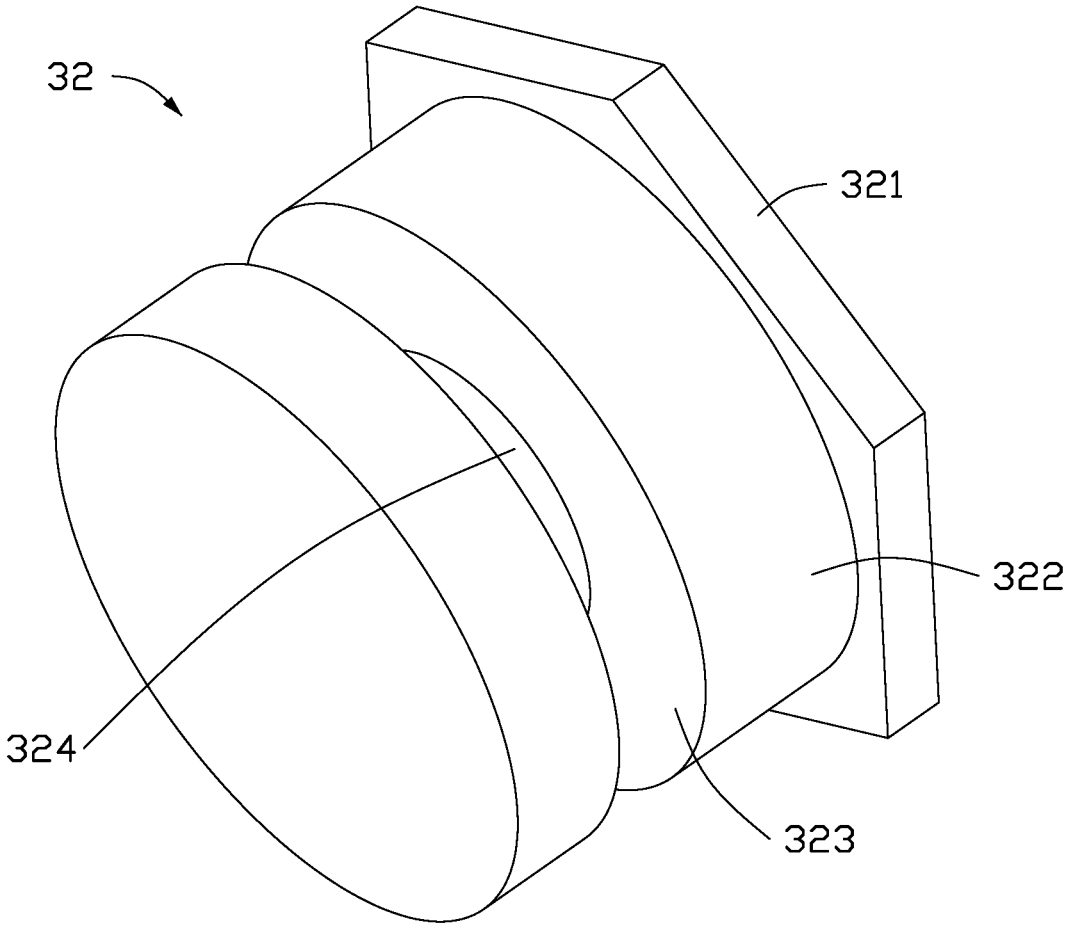
FIG. 10 is a perspective view of a support block of the adjustable partition structure.
Figure 11:
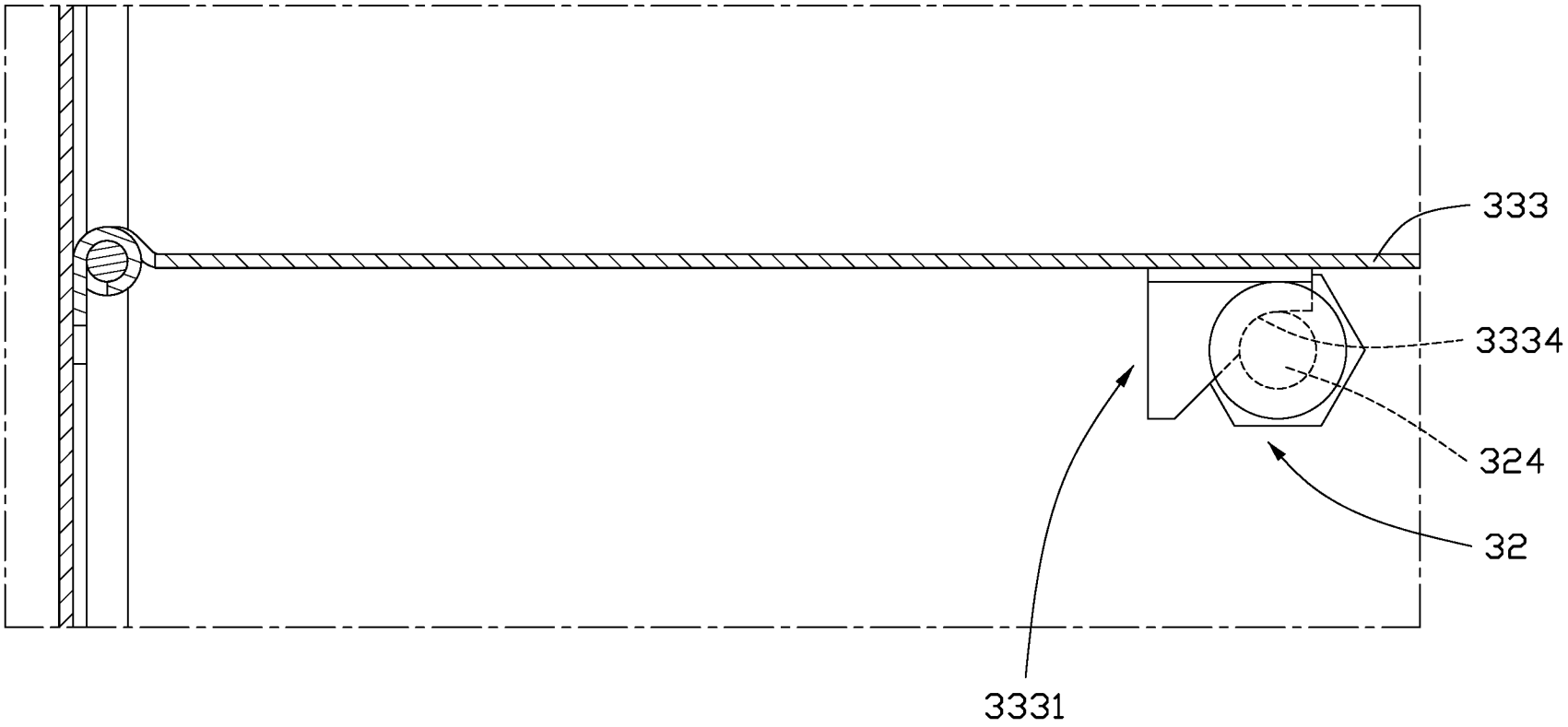
FIG. 11 is a cross-sectional view showing a state of use of the adjustable partition structure.

As shown in FIG. 10, the support block 32 includes a flange 321 and a support block body 322 extending from the flange 321. The support block 32 is riveted to the side plate 113 through the flange 321, so that the support block body 322 protrudes from an inner surface of the side plate 113. The support block body 322 defines an annular groove 323 to form a latching post 324. As shown in FIG. 2, the abutting piece 3331 includes a curved portion including a horizontal portion 3332 and a vertical portion 3333. The vertical portion 3333 has a concave curved surface 3334. As shown in FIG. 11, when the adjustable partition plate 333 is in a horizontal position, the concave curved surface 3334 engages with the engaging post 324 to support the adjustable partition plate 333 in the horizontal position.

As shown in FIG. 2, the adjustable partition structure 3 further includes a latching hook 34. The latching hook 34 is fixed on the rear plate 114, and the adjustable partition plate 333 defines a latching hole 3335. As shown in FIG. 8, when the adjustable partition plate 333 is pivoted to abut against the rear plate 114, the adjustable partition plate 333 can be supported in a vertical position by the latching hook 34 engaging with the latching hole 3335.

Figure 12:
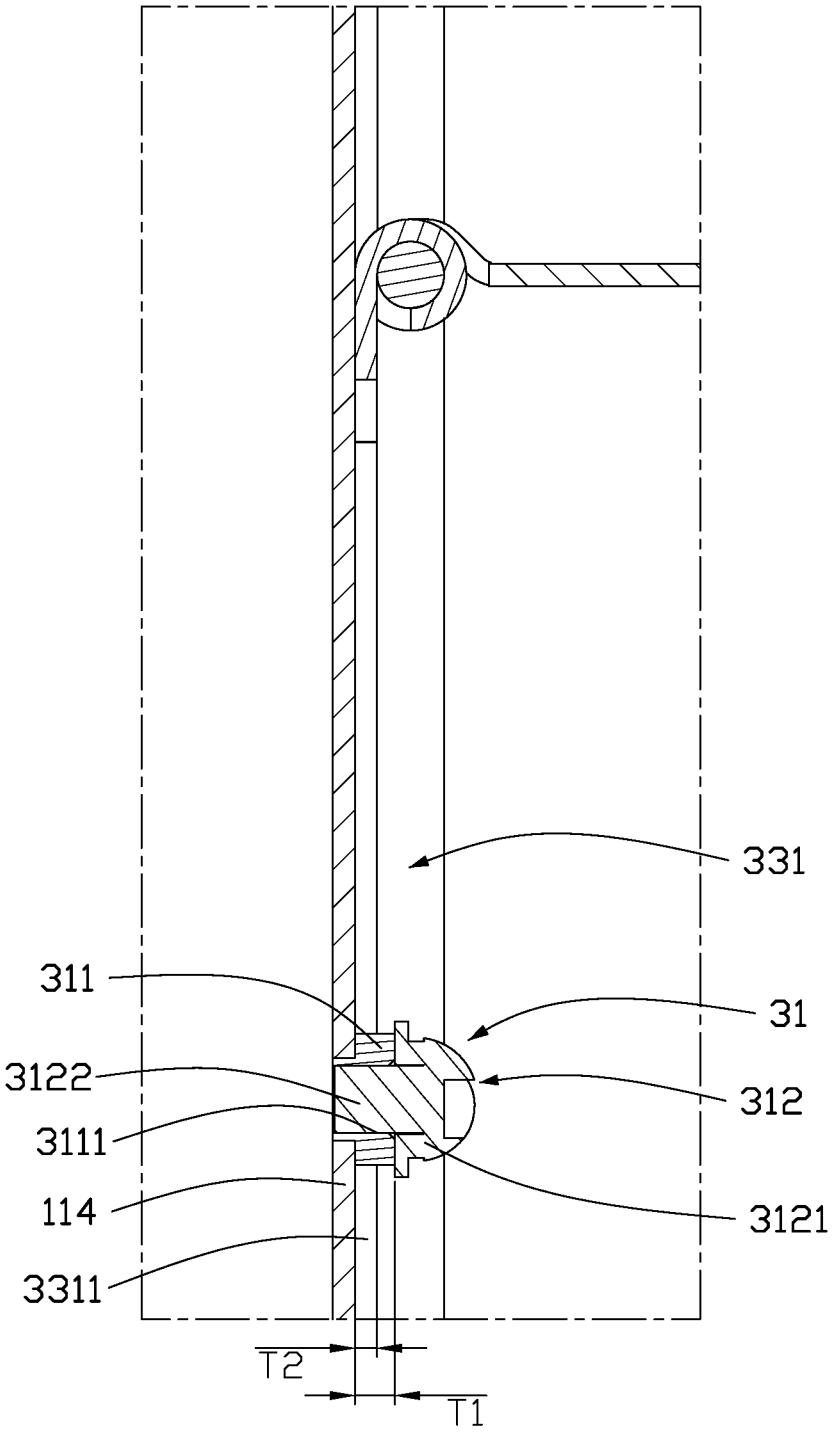
FIG. 12 is a cross-sectional view of a guiding member of the adjustable partition structure.

As shown in FIG. 12, the guiding member 31 includes a standoff 311 and a screw 312. One end of the standoff 311 is riveted to the rear plate 114, and another end of the standoff 311 protrudes from the rear plate 114 and is received in the sliding hole 3311. The standoff 311 defines a threaded hole 3111. The screw 312 includes a head portion 3121 and a threaded portion 3122 extending from the head portion 3121. The threaded portion 3122 is screwed in the threaded hole 3111 of the standoff 311, the head portion 3121 abuts against the standoff 311 to position the sliding member 331. The standoff 311 protrudes from the rear plate 114 by a thickness T1 that is greater than a thickness T2 of the sliding member 331, so that the sliding member 331 can be smoothly slid relative to the rear plate 114. In one embodiment, the screw 312 is a tamper-proof screw, the standoff 311 protrudes from the rear plate 114 by a thickness T1 of 2.5 mm, and the sliding member 331 has a thickness T2 of 2 mm.

As shown in FIG. 3, each set of support blocks 32 has three support blocks 32*a*, 32*b*, 32*c* arranged in a longitudinal direction, so that the adjustable partition plate 333 can be supported at three different heights to adjust a size of the storage space 13.

Figure 13:
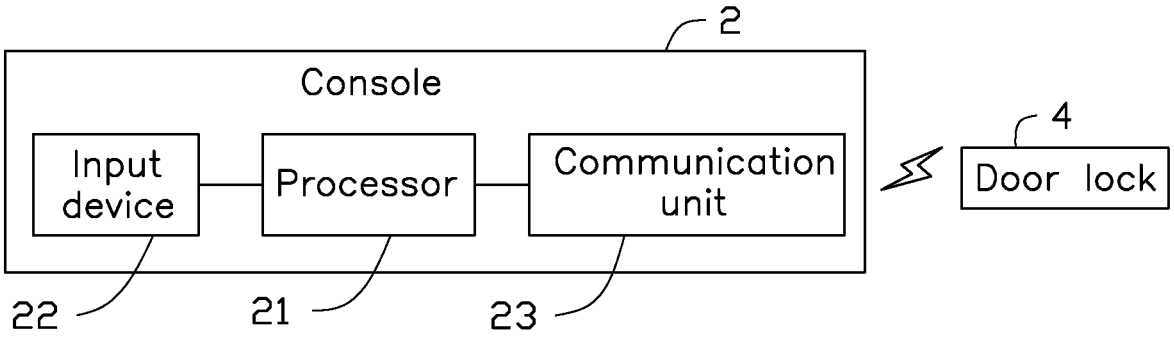
FIG. 13 is a block diagram of a console of the smart logistics cabinet.

As shown in FIG. 1, the console 2 is disposed on the frame 11 of the cabinet 1. The console 2 is operable to control opening and closing of the door lock 4. As shown in FIG. 13, the console 2 includes a processor 21, an input device 22, and a communication unit 23. The input device 22 and the communication unit 23 are both coupled to the processor 21. The input device 22 can be a touch screen, and the communication unit 23 communicates with the door lock 4. To drop off an item for delivery in the cabinet 1, a shipping code is first obtained from a website of a logistics provider or from a logistics application, and the shipping code is input to the input device 22, so that the communication unit 23 transmits an unlocking signal to the corresponding door lock 4 to open the corresponding storage space 13 to place the item. To pick up an item from the cabinet 1, a pick-up code is first obtained from the website or the application, and then the pick-up code is input to the input device 22, so that the communication unit 23 transmits an unlocking signal to the corresponding door lock 4 to open the corresponding storage space 13.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An adjustable partition structure comprising:

at least one guiding member fixed to a rear plate of a cabinet;

at least two sets of support blocks respectively disposed on two side plates of the cabinet, each set of the support blocks comprising a plurality of support blocks arranged in a longitudinal direction of the side plates; and an adjustable partition comprising:

at least one sliding member defining a sliding hole; and an adjustable partition plate; wherein:

the guiding member is received in the sliding hole;

the sliding member is slidable relative to the rear plate along the guiding member;

the adjustable partition plate and the sliding member are rotationally coupled together;

two side edges of the adjustable partition plate respectively form an abutting piece;

the two abutting pieces are configured to be supported by the support blocks on the two side plates on a same plane to support the adjustable partition plate.

2. The adjustable partition structure of claim 1, wherein:

the adjustable partition structure comprises at least one pivot shaft;

one end of the adjustable partition plate is pivotably coupled to an end of the sliding member by the pivot shaft.

3. The adjustable partition structure of claim 1, wherein:

the support block comprises a flange and a support block body extending from the flange;

the support block is riveted to the side plate through the flange, and the support block body protrudes from an inner surface of the side plate.

4. The adjustable partition structure of claim 3, wherein:

the support block body defines an annular groove to form a latching post;

the abutting piece includes a horizontal portion and a vertical portion;

the vertical portion comprises a concave curved surface;

when the adjustable partition plate is supported by the support blocks, the concave curved surface engages with the latching post to support the adjustable partition plate.

5. The adjustable partition structure of claim 3, wherein:
the adjustable partition structure further comprises a latching hook fixed on the rear plate;
the adjustable partition plate defines a latching hole;
the adjustable partition plate is supported by the latching hook engaging with the latching hole.

6. The adjustable partition structure of claim 3, wherein:
the guiding member comprises a standoff and a screw;
one end of the standoff is riveted to the rear plate, and another end of the standoff protrudes from the rear plate and is received in the sliding hole;
the standoff defines a threaded hole;
the screw comprises a head portion and a threaded portion extending from the head portion;
the threaded portion is screwed in the threaded hole;
the head portion abuts against the standoff to position the sliding member.

7. The adjustable partition structure of claim 6, wherein:
the standoff protrudes from the rear plate by a thickness that is greater than a thickness of the sliding member.

8. The adjustable partition structure of claim 3, wherein:
each set of the support blocks comprises three support blocks arranged along a longitudinal direction of the side plate.

9. A smart logistics cabinet comprising:
a cabinet comprising:
a frame comprising a rear plate and at least two side plates;
a plurality of fixed partition plates mounted within the frame to define a plurality of storage spaces;
a door frame disposed at an opening of each of the storage spaces; and
a door panel rotationally mounted on the door frame and comprising an electronic door lock configured to lock the door panel to the door frame;
a console disposed on the cabinet and being operable to control opening and closing of the door lock; and
an adjustable partition structure mounted within each of the storage spaces, each adjustable partition structure comprising:
at least one guiding member fixed to the rear plate;
at least two sets of support blocks respectively disposed on the two side plates, each set of the support blocks comprising a plurality of support blocks arranged in a longitudinal direction of the side plates; and
an adjustable partition comprising:
at least one sliding member defining a sliding hole; and
an adjustable partition plate; wherein:
the guiding member is received in the sliding hole;
the sliding member is slidable relative to the rear plate along the guiding member;
the adjustable partition plate and the sliding member are rotationally coupled together;
two side edges of the adjustable partition plate respectively form an abutting piece;
the two abutting pieces are configured to be supported by the support blocks on the two side plates on a same plane to support the adjustable partition plate.

10. The smart logistics cabinet of claim 9, wherein:
the console comprises a processor, an input device, and a communication unit;
the input device and the communication unit are both coupled to the processor;
the communication unit communicates with the door lock to control the door lock to control opening and closing of the door lock.

11. The smart logistics cabinet of claim 10, wherein:
the adjustable partition structure comprises at least one pivot shaft;
one end of the adjustable partition plate is pivotably coupled to an end of the sliding member by the pivot shaft.

12. The smart logistics cabinet of claim 10, wherein:
the support block comprises a flange and a support block body extending from the flange;
the support block is riveted to the side plate through the flange, and the support block body protrudes from an inner surface of the side plate.

13. The smart logistics cabinet of claim 11, wherein:
the support block body defines an annular groove to form a latching post;
the abutting piece includes a horizontal portion and a vertical portion;
the vertical portion comprises a concave curved surface;
when the adjustable partition plate is supported by the support blocks, the concave curved surface engages with the latching post to support the adjustable partition plate.

14. The smart logistics cabinet of claim 13, wherein:
the adjustable partition structure further comprises a latching hook fixed on the rear plate;
the adjustable partition plate defines a latching hole;
the adjustable partition plate is supported by the latching hook engaging with the latching hole.

15. The smart logistics cabinet of claim 13, wherein:
the guiding member comprises a standoff and a screw;
one end of the standoff is riveted to the rear plate, and another end of the standoff protrudes from the rear plate and is received in the sliding hole;
the standoff defines a threaded hole;
the screw comprises a head portion and a threaded portion extending from the head portion;
the threaded portion is screwed in the threaded hole;
the head portion abuts against the standoff to position the sliding member.

16. The smart logistics cabinet of claim 15, wherein:
the standoff protrudes from the rear plate by a thickness that is greater than a thickness of the sliding member.

17. The smart logistics cabinet of claim 13, wherein:
each set of the support blocks comprises three support blocks arranged along the longitudinal direction of the side plate.

* * * * *